US007066320B2

(12) United States Patent
Sansolo

(10) Patent No.: US 7,066,320 B2
(45) Date of Patent: Jun. 27, 2006

(54) DETONATOR PROTECTOR

(76) Inventor: Arie Sansolo, 19 Harel Street, Ashkelon (IL) 78649

( * ) Notice: Subject to any disclaimer, the term of this patent is extended or adjusted under 35 U.S.C. 154(b) by 166 days.

(21) Appl. No.: 10/802,781

(22) Filed: Mar. 18, 2004

(65) Prior Publication Data

US 2006/0108237 A1 May 25, 2006

(51) Int. Cl.
*F42B 39/00* (2006.01)

(52) U.S. Cl. ..... 206/3; 206/446

(58) Field of Classification Search ..... 206/3, 206/521, 585, 588, 446; 89/34, 1.801
See application file for complete search history.

(56) References Cited

U.S. PATENT DOCUMENTS 1,988,034 A * 1/1935 Dolan ..... 206/3
2,356,969 A * 8/1944 Blum ..... 206/3
3,160,061 A * 12/1964 Moy ..... 206/3
3,536,225 A * 10/1970 Pech ..... 206/446
4,940,135 A * 7/1990 Hall ..... 206/3
5,212,337 A * 5/1993 Patteri et al. ..... 89/34
5,542,333 A * 8/1996 Hagelberg et al. ..... 89/1.81
6,357,582 B1 * 3/2002 Fischer ..... 206/3

* cited by examiner

*Primary Examiner*—Luan K. Bui
(74) *Attorney, Agent, or Firm*—Dekel Patent Ltd.; David Klein

(57) ABSTRACT

A detonator protector including a housing fitted with an end cap at one end thereof and a plug at another end thereof, and at least two chambers disposed in the housing, one chamber being of sufficient size to receive a detonator therein, that chamber being disposed inside another of the chambers, at least two of the chambers being formed with a plurality of holes along a longitudinal length thereof.

11 Claims, 1 Drawing Sheet

DETONATOR PROTECTOR

FIELD OF THE INVENTION

The present invention relates to a protector for detonators and a method of packaging detonators for transport and storage, or for isolating detonators from the environment.

BACKGROUND OF THE INVENTION

Detonators may be broadly divided into two types, either electric or non-electric, depending on the manner in which they are initiated. When detonators are attached to an initiation means such as electric leg-wires or signal tubing, the assembled unit is commonly termed a detonator assembly.

Electric detonators generally have a fuse head within the detonator shell, the fuse head being initiated by electric current transmitted along the leg-wires.

Non-electric detonators are commonly attached to a length of signal tubing, which comprises plastic tubing, lightly coated on the inside with a reactive powder which is capable of transmitting a shock wave to the detonator and thus initiating it.

The importance of safely protecting detonators during storage or transportation is clear. It is also important for sappers to be able to isolate detonators from causing injury to nearby persons.

Various attempts have been made in the past to protect detonators during storage or transportation.

For example, PCT published patent application WO9519539 describes a detonator protector, which is open at one end for insertion of a detonator and closed at the other end, and which radially encloses the base charge of the detonator. A wall is radially spaced around a detonator holder, so that a space is defined between the wall and the detonator holder. The free volume provided around the base charge of the detonator plus the outer are said to provide protection in the event that the detonator is accidentally detonated. The protector is constructed of high density polyethylene (HDPE).

Another example of a transportation holder and package for detonators is described in U.S. Pat. No. 5,133,258 to Rock et al. This is a non-propagating holder and package for explosive devices, such as blast caps. Each cap is contained in an internal cavity in a holder, and surrounded by radially-spaced, elastomeric walls. The holders are arrayed in a container, and absorb the energy released by accidental detonation of one cap to prevent sympathetic detonation of others in the package.

SUMMARY OF THE INVENTION

The present invention seeks to provide a safe detonator protector, as is described more in detail hereinbelow. The detonator protector of the invention may not cause damage to the hand of the user even if the detonator contained therein accidentally detonates while the protector is held in the hand.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figure 1:
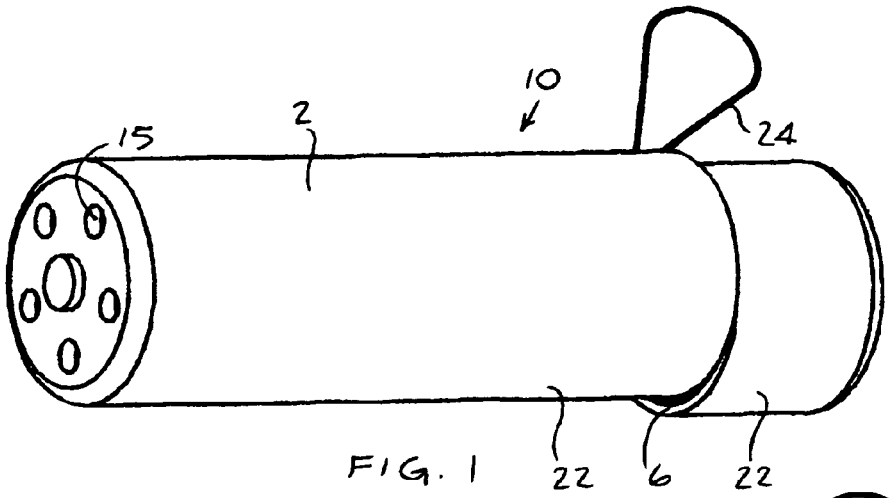
FIGS. 1, 2 and 3 are simplified pictorial, sectional and exploded illustrations, respectively, of a detonator protector, constructed and operative in accordance with an embodiment of the present invention.
Figure 2:
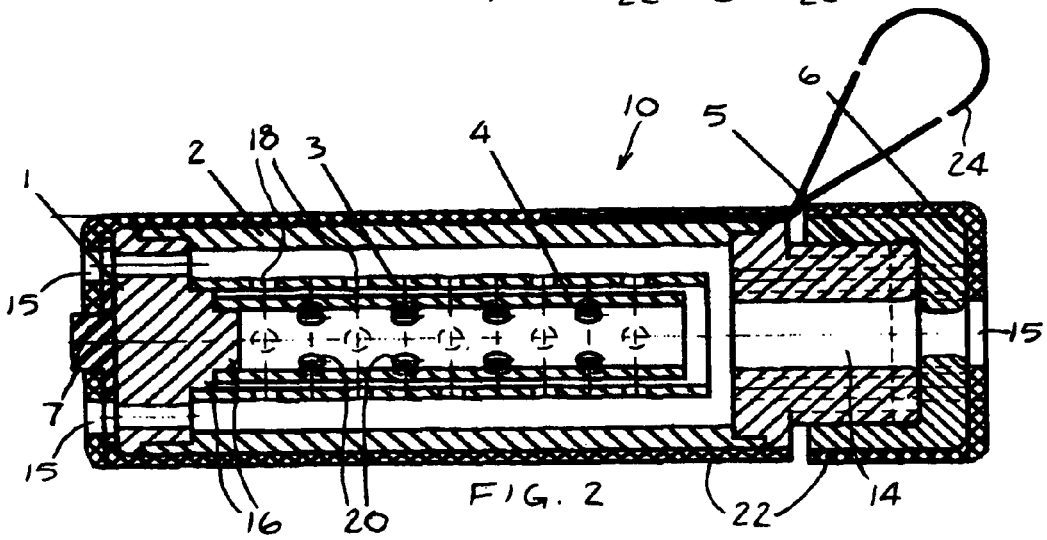
Figure 3:
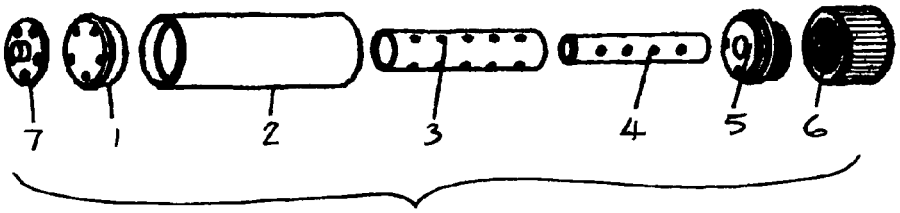

Reference is now made to FIGS. 1–3, which illustrate a detonator protector 10, constructed and operative in accordance with an embodiment of the present invention.

Detonator protector 10 may include a housing 2, such as but not limited to, a cylindrically shaped housing. One end of housing 2 may be fitted with an end cap 1, which may be formed with one or more apertures 12 for releasing fluids, such as gas, fumes or liquid substances from an explosion. An opposite end of housing 2 may be fitted with a plug 5, which may be also formed with one or more apertures 14 for releasing fluids from an explosion. End cap 1 and plug 5 may be secured to housing 2 by any means, such as but not limited to, screw threads, welding, bonding and the like.

An outer cap 6 may be secured to plug 5 by any suitable method, such as but not limited to, a screw thread connection. Another outer cap 7 may be secured to end cap 1 by any suitable method. Outer caps 6 and 7 may be also formed with one or more apertures 15 for releasing fluids from an explosion.

One or more inner chambers may be disposed in housing 2. In the illustrated embodiment, two inner chambers 3 and 4 are provided, chamber 4 being inside chamber 3 and generally concentric therewith. Chambers 3 and 4 may be generally concentric with housing 2 as well. Chambers 3 and 4 may be secured to end cap 1, such as by securing them to mounting protrusions 16 formed on end cap 1, by any means, such as but not limited to, screw threads, welding, bonding and the like. Chamber 4 may be sized and shaped so that any kind of detonator (not shown) may be placed therein.

Chambers 3 and 4 may be formed with a generally cylindrical shape with a plurality of holes 18 and 20, respectively, formed along a longitudinal length thereof. The holes 18 and 20 may be spaced generally equidistantly from one another about the perimeter of chamber 3 and 4, respectively. The holes 18 and 20 may be arranged for fluid (e.g., gas, fumes or liquid) products of an explosion to pass therethrough. Chambers 3 and 4 may be arranged relative to one another so that the holes 18 of chamber 3 are spaced angularly (e.g., perpendicularly) from the holes 20 of chamber 4. In this manner, the fluid products of an explosion of a detonator exploding in chamber 4 are first released through holes 20, but do not pass directly through holes 18 of chamber 3. Instead the fluid explosive products must expend energy until they are released through holes 18 of chamber 3, thereby significantly attenuating the explosive force. Furthermore, the holes 18 and 20 may be symmetrically spaced from one another (e.g., perpendicularly). This, plus the apertures in end cap 1/outer cap 7 and plug 5/outer cap 6, may tend to balance the explosive force emanating from detonator protector 10, with the result that detonator protector 10 may hardly move during detonation of a detonator contained therein. Thus, detonator protector 10 may not cause damage to the hand of a user even if the detonator contained therein accidentally detonates while the protector is held in the hand.

All the components of detonator protector 10 may be constructed, without limitation, of a sturdy metal, e.g., stainless steel. Outer cap 7 may be constructed, without limitation, of a plastic, e.g., DELRIN.

Detonator protector 10 may be at least partially covered on the inside or outside or both with a protective coating or covering 22 (the terms being used interchangeably throughout), such as but not limited to, cross-linkable heat shrink polymers, polyurethane, HDPE, elastomers (e.g., natural or synthetic rubbers) and others. The coating 22 may be electrically insulating, which may add safety when detonator protector 10 is used for storing therein electric detonators. The coating 22 may also provide extra shock absorption against explosive forces.

The protector of the current invention may be used as an independent unit or two or more may be joined together or manufactured together to form a set.

A handle 24 (such as but not limited to a strap) may be attached to detonator protector 10. Handle 24 may be made, without limitation, of plastic, metal or leather, and may or may not be coated as well with a coating like coating 22. Handle 24 may be used as a carrying handle. Handle 24 may be secured over outer cap 6 to ensure that a detonator stored inside detonator protector 10 does not accidentally fall out during handling or transportation.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A detonator protector comprising:

a housing fitted with an end cap at one end thereof and a plug at another end thereof; and two chambers disposed in said housing, one chamber being of sufficient size to receive a detonator therein, that chamber disposed inside an the other of said chambers, two of said chambers being formed with a plurality of holes along a longitudinal length thereof, wherein said end cap and said plug are each formed with at least one aperture for releasing a fluid therethrough.

2. The detonator protector according to claim 1, wherein said chambers are generally concentric with another.

3. The detonator protector according to claim 1, wherein said chambers are generally concentric with said housing.

4. The detonator protector according to claim 1, wherein said chambers are secured to said end cap.

5. The detonator protector according to claim 1, wherein the holes of at least one of said chambers are spaced generally equidistantly from one another about the perimeter of said chamber.

6. The detonator protector according to claim 1, wherein the holes of at least one of said chambers are symmetrically spaced from one another.

7. The detonator protector according to claim 1, wherein said chambers are arranged from the holes of another of said chambers.

8. The detonator protector according to claim 7, wherein the holes of one of said chambers are spaced perpendicularly from the holes of another of said chambers.

9. The detonator protector according to claim 1, wherein said detonator protector is at least partially covered with a protective coating.

10. The detonator protector according to claim 9, wherein said protective coating is electrically insulating.

11. The detonator protector according to claim 1, further comprising a handle attached therein.

* * * * *